United States Patent [19]

Wahl et al.

[11] 4,154,624

[45] May 15, 1979

[54] APPARATUS AND METHOD FOR CLEANING CONTAINERS

[75] Inventors: Alois Wahl; Paul Elsner, both of Bad Kreuznach; Gerhard Born, Bingen, all of Fed. Rep. of Germany

[73] Assignee: Seitz-Werke GmbH, Bad Kreuznach, Fed. Rep. of Germany

[21] Appl. No.: 798,809

[22] Filed: May 20, 1977

[30] Foreign Application Priority Data

May 20, 1976 [DE] Fed. Rep. of Germany ..... 2622434

[51] Int. Cl.[2] ..... B67C 1/00

[52] U.S. Cl. ..... 134/10; 134/13; 134/23; 134/25 A; 134/30; 134/56 R; 134/60; 134/73; 134/105; 134/109

[58] Field of Search ..... 134/10, 13, 23, 25 A, 134/30, 32, 33, 60, 73, 74, 56 R, 105, 109

[56] References Cited

U.S. PATENT DOCUMENTS

| | | | |
|---|---|---|---|
| 797,298 | 8/1905 | Loew | 134/30 X |
| 2,681,872 | 6/1954 | McCabe | 134/60 X |
| 3,951,158 | 4/1976 | Tedden | 134/60 |

FOREIGN PATENT DOCUMENTS

| | | | |
|---|---|---|---|
| 1153281 | 8/1963 | Fed. Rep. of Germany | 134/60 |
| 2510927 | 9/1975 | Fed. Rep. of Germany | 134/60 |
| 494342 | 4/1976 | U.S.S.R. | 134/60 |

*Primary Examiner*—Marc L. Caroff
*Attorney, Agent, or Firm*—Walter Becker

[57] ABSTRACT

A cleaning machine for containers, especially bottles, which includes an endless transporting system for transporting containers to be cleaned through the machine, and which also includes a water pre-softening arrangement comprising at least two softening baths arranged one behind the other when viewed in the container transporting direction of the transporting system with the respective front bath having a lower temperature than the respective succeeding bath. The transporting system is over a considerable portion of its transporting path passed through the softening baths in submerged condition so as to also submerge therein the containers being transported by the transporting system.

17 Claims, 3 Drawing Figures

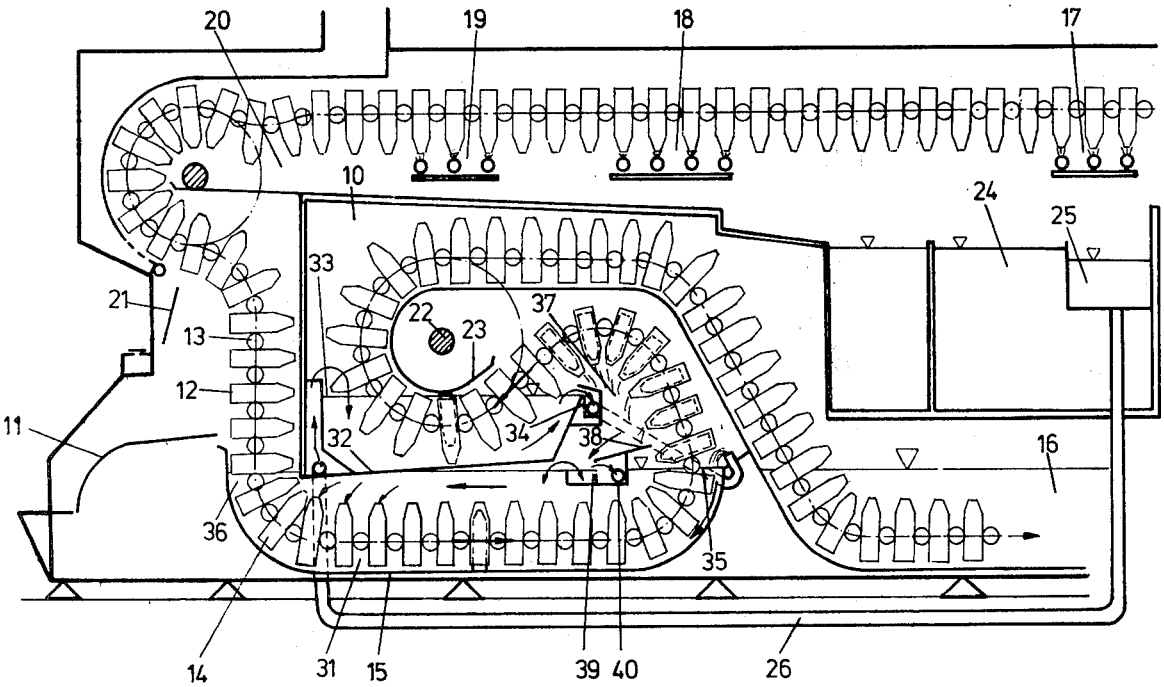

APPARATUS AND METHOD FOR CLEANING CONTAINERS

The present invention relates to a cleaning machine for containers, especially for bottles, with pre-water softening, a lye softening bath and a spray and drip zones arranged therebetween and past same.

It is known to equip bottle-cleaning machines with water pre-softening means in the form of a one-step pre-softening bath. This serves for pre-cleaning the bottles, and in particular for removing coarse soiling and residues from beverages. Moreover, this is of particular importance for the temperature equalization of the bottles and of the circulating transporting device comprising chains, bottle baskets, and bottle cells, and also for the spray water admitted from the spray zones. Such an arrangement, however, has the drawback that the heretofore customary single one-step water pre-softening bath brings about only an incomplete temperature equalization and furthermore creates a problem for the setting of the bath temperature. If, for instance, due to seasonal effects, the containers to be cleaned, especially glass bottles, are relatively cold, it is necessary in order to avoid too high a temperature change and a breakage of the bottles as a result thereof, to set the temperature of the water pre-softening bath likewise relatively low. Such temperature adjustment in the water pre-softening bath, in conformity with the respective prevailing conditions, fails as a rule in view of the fact that due to the short time periods (customary with machines of high output) during which bottles pass through the lye softening bath for a proper cleaning of the bottles, a high lye temperature is necessary in conformity with which the temperature in the spray zone has to be selected in order to avoid bottle breakage in the warm water spraying zone which follows the lye treatment. Inasmuch as this spray water to which the circulating conveying device conveys heat absorbed from the lye treatment, subsequently serves for feeding the water pre-softening bath, said spray water determines the temperature in the water softening bath which as a result thereof is mostly higher than the desired setting values. Furthermore, in view of the occurring harmful ecological effects inherent thereto, it is impermissible for the liquid overflowing from the water pre-softening bath, to discharge at a high temperature, into the open, aside from the fact that this would also not be economical in view of the high energy loss inherent thereto.

It is also known to carry out a two-step pre-treatment of the bottles to be cleaned and to do so by introducing the bottles first into a water pre-softening bath, subsequently emptying said bottles so treated and prior to the introduction of said bottles into the lye softening bath to subject the bottles to a spray treatment with warm water (Schweizer Brauerei-Rundschau, Jahrgang 77, Nr. 1, January 66, Page 36).

In this connection, the spray water is collected in a collecting pan immersed into the lye softening bath, while the spray water absorbs heat from the lye softening bath whereupon the spray water is conveyed to the water softening bath. Also with this arrangement, it is not possible to obtain a setting of the temperature of the water pre-softening bath which temperature is adapted to the various requirements; it is likewise not possible to adapt the temperature of the bottles to be cleaned to the subsequent lye softening bath because the quantity of heat given off during the spray treatment to the bottles and to the transporting device is insufficient for a temperature adaptation.

It is, therefore, an object of the present invention with container cleaning machines of the above mentioned general type to provide a temperature adaptation which practically excludes breakage of the containers to be cleaned and introduced into the water pre-softening substance, to the temperature conditions prevailing in the lye softening bath, while simultaneously the entire heat content balance or heat economy is improved within the machine and the water flowing off from the water softening bath is lowered to admissible and economical temperatures.

These and other objects and advantages of the invention will appear more clearly from the following specification in connection with the accompanying drawings, in which.

Figure 1:
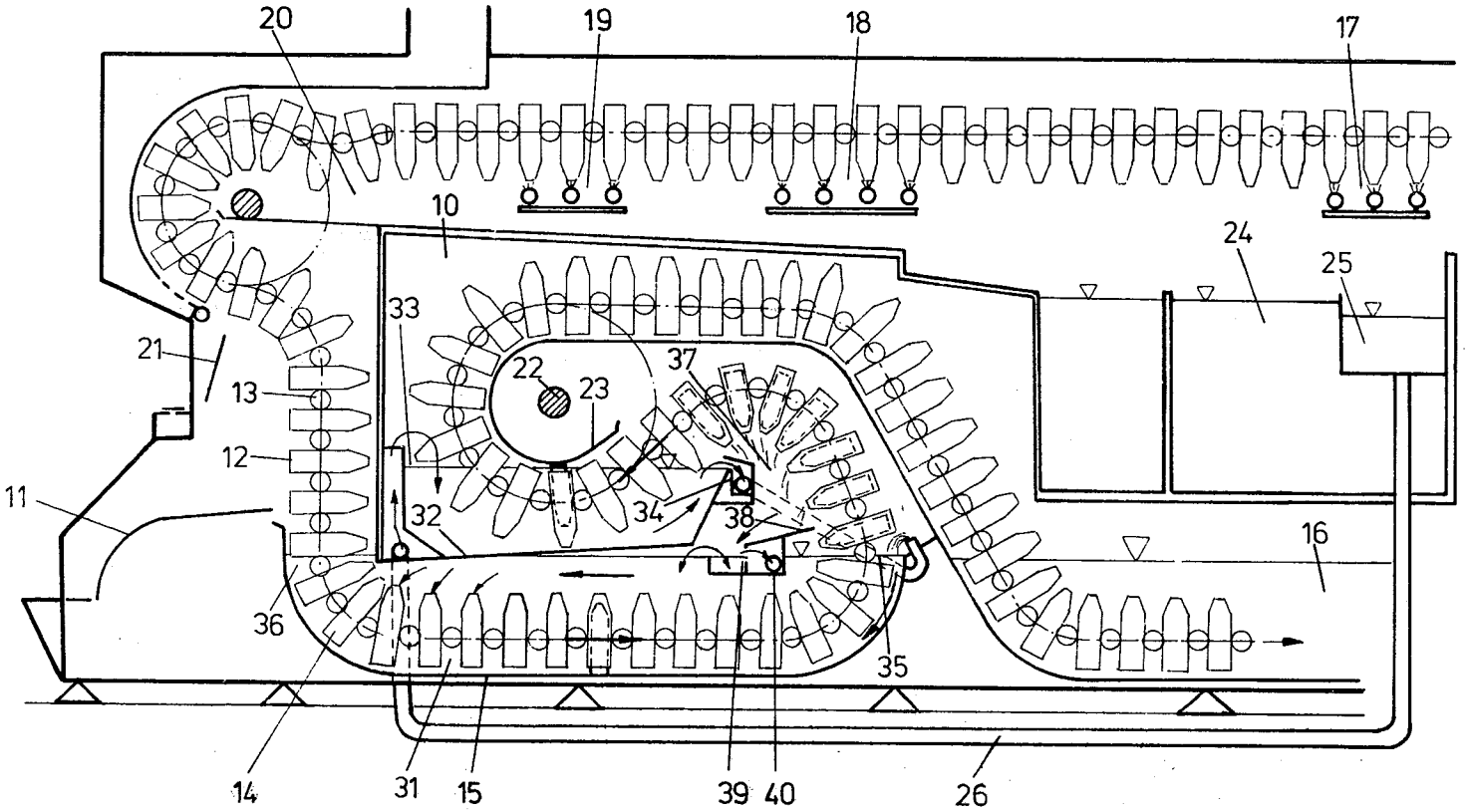
FIG. 1 shows a portion of a multi-bath bottle-cleaning machine with a two-step water softening arrangement according to the invention.

The machine for cleaning containers, especially bottles, according to the invention which has a water pre-softening arrangement, a lye softening bath and spray and dripping zones arranged therebetween and past said water pre-softening arrangement and lye softening bath, is characterized primarily in that the water pre-softening arrangement is subdivided into at least two softening baths arranged one behind the other when looking in the transporting direction of said containers, while the respective preceding bath has a lower temperature than the respective succeeding bath. The container-cleaning machine according to the invention is furthermore characterized in that the transporting device is passed through the softening baths in such a way that the temperature device as well as the conveyed containers are over a considerable portion of their transport through the baths submerged in the respective bath liquid.

The preceding and subsequent softening bath may according to the invention be so arranged that a substantial portion of the bath fluid of the subsequent softening bath passes into the preceding softening bath. To this end, preferably the bath liquid is from the coolest region of the subsequent or succeeding softening bath introduced into the warmest region of the preceding softening bath. According to a preferred embodiment of the invention, this can advantageously be realized by arranging the subsequent softening bath above the preceding softening bath, while the introduction of the bath liquid is effected by overflowing from the subsequent softening bath into the preceding softening bath. Due to this arrangement, an emptying zone for the containers can be created in a particularly simple manner, and the transistion of the containers with the opening pointing in upward direction into the container positions with the opening pointing downwardly can be made possible within a very short distance between the preceding and the subsequent softening bath. Expediently, within the region of the container exit, the preceding softening bath may have associated therewith a collecting plate for the bath liquid running out of the containers. This collecting plate returns the collected liquid into an intermediate or front region of the preceding softening bath so that the relatively cool region of the preceding softening bath remains substantially unaffected by the returned liquid as far as its temperature behavior is concerned. The invention also makes it possible in the subsequent softening bath by the addition of special treatment substances to carry out an outer treatment of the containers whereby labels, foils, capsules and the like are removed.

According to the invention, the supply of liquid to the softening bath may be effected in various ways. Thus, liquid may be supplied to the subsequent softening bath in the warmest region thereof from a warmer treatment zone. Such an arrangement will be preferred when the warm liquid to be conveyed to the subsequent softening bath is with regard to its composition suitable as bath liquid for the softening baths, for instance spray liquid, which in other treatment zones has been consumed to a major extent. On the other hand, it is also possible to introduce only the heat from a hotter treatment zone of the machine into a subsequent softening bath while the liquid serving as heat carrier is used for still other purposes. In such an instance, it is suggested according to the invention that the subsequent softening is equipped with a heat exchanger means which at the liquid outlet is connected to a warmer treatment zone for heating up the subsequent softening bath. The heat exchanging device may for instance with its inlet be connected to the liquid outlet of the spray vat of a hot water spraying zone and may have its exit connected to a water regenerating desalting device from where the regenerated spray water is conveyed to the same or another spraying zone. This bring about the particular advantage that the employed spray water is made use of to an optimum extent. A portion of the heat of the water which has left such warm water spray zone, benefits the subsequent softening bath. In this connection, the water in the heat exchanger heats up to a temperature as it is favorable for a subsequent de-salting operation and the subsequent spray treatment. In such instances, the heat required for the heating up of the containers and the portions of the transporting device is conveyed to the preceding softening bath in a simple manner together with the warm bath liquid which from the subsequent softening bath passes into the preceding softening bath.

According to a modification, the spray liquid withdrawn from the collecting vat and tempered by means of a heat exchanger may also without additional intermediate treatment be used directly for tempering the spray liquid collected in the collecting vat or may be employed as spray liquid for the spraying zone from which it is withdrawn.

According to another embodiment of the invention, which is based on the finding that lye residues originating in the lye treatment are conveyed from the containers and the transporting devices, in most instances conveyed to the spray water zone, spray water can be directly withdrawn from the spray water directly following the lye treatment, and can be fed to the warmest bath region of the subsequent softening bath, whereas bath liquid can be withdrawn from the coldest region of the subsequent softening bath for the regeneration and the de-salting device. This last mentioned bath liquid can after effected treatment, for purposes of regeneration be conveyed to that water spray zone from which it was withdrawn for the subsequent softening bath. In this way, a favorable spray water circulation is obtained in which a de-salting device working in conformity with the principle of the reverse osmosis can be employed with a preceding ultrafiltration step as regenerating device for the water and lye recovery and can work in an optimum manner. With such a spray water circulation which includes the subsequent pre-softening bath, it is possible if desired to do without the liquid overflow into the preceding softening bath in order to avoid losses in lye. In such an instance, the spray liquid expediently withdrawn from the warm water spray zone is conveyed to the preceding softening bath at a temperature which is adapted to the temperature of the bath liquid in its warmest bath region. In addition thereto, with this embodiment according to which the subsequent softening bath is included directly into the spray water circulation, water may be fed to the de-salting plant which works in conformity with the principle of the reverse osmosis. This water has temperatures and pH values suitable for the osmosis method. In these circumstances, the substantially closed spary water circuit may be equipped with a controlled quantity control valve which expediently is inserted into a conduit which leads from the spray vat of a water spray zone directly following the lye treatment, to the subsequent softening bath. This quantity control valve may expediently be controlled by a level control (Standhöhenmesser) in the subsequent softening bath.

For purposes of continuously post delivering the required quantity liquid and heat, the subsequent softening bath and/or the preceding softening bath may through dosing devices be connected to a warm water supply. These dosing devices may be controlled by the bath temperature measured at the subsequent softening bath and/or preceding softening bath. In case of liquid being passed from the subsequent softening bath to the preceding softening, for instance by an overflow, the warm water supply may be effected by the preceding pre-softening bath because in such an instance, the subsequent softening bath supplies the preceding softening bath with liquid and heat. If the subsequent softening bath, however, is included in another liquid circuit for instance in a spray water circuit, the preceding softening bath may be equipped with a water supply and as the case may be, a temperature control.

Figure 2:
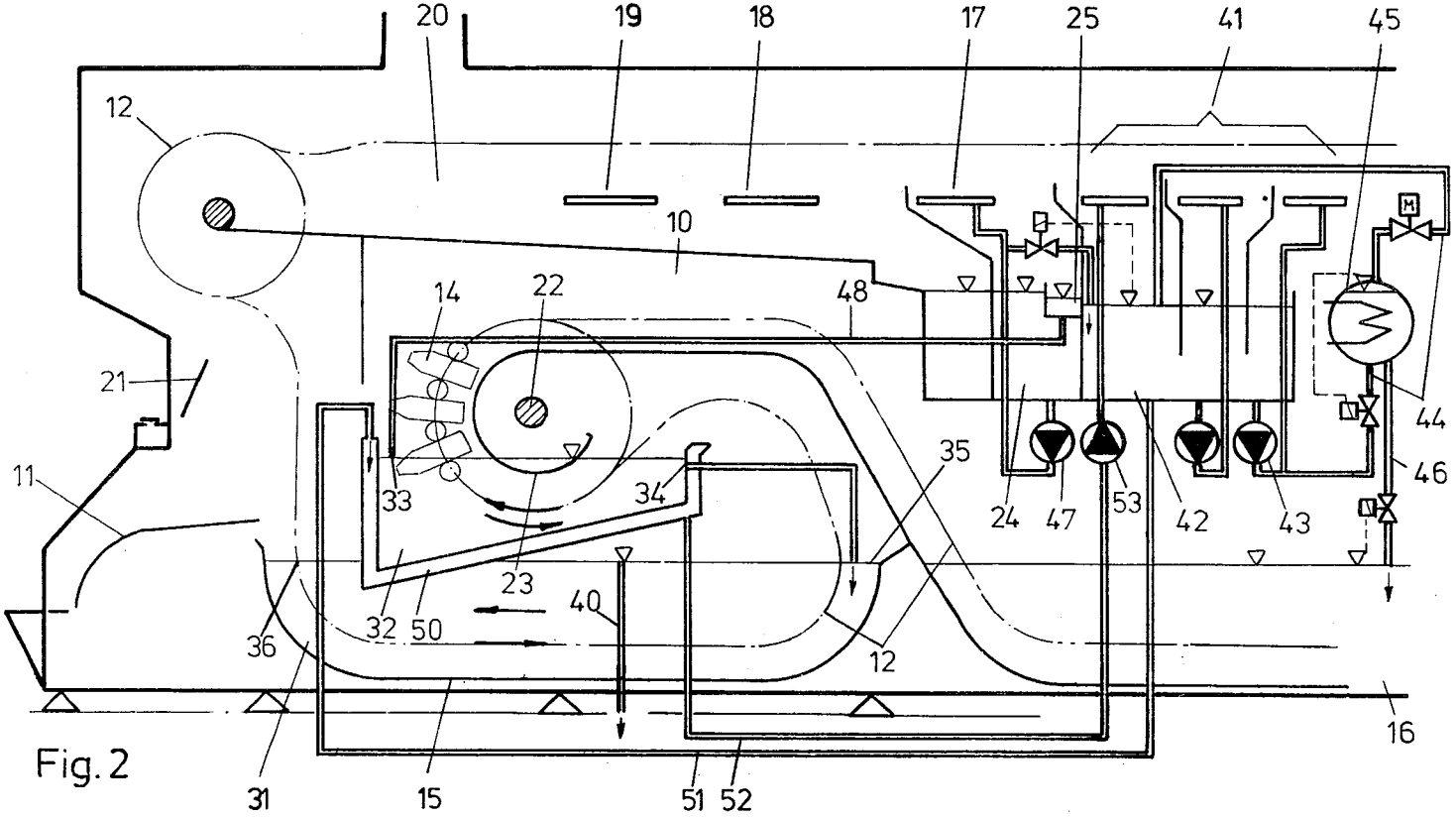
FIG. 2 represents a multi-bath bottle-cleaning machine modified over that of FIG. 1.
Figure 3:
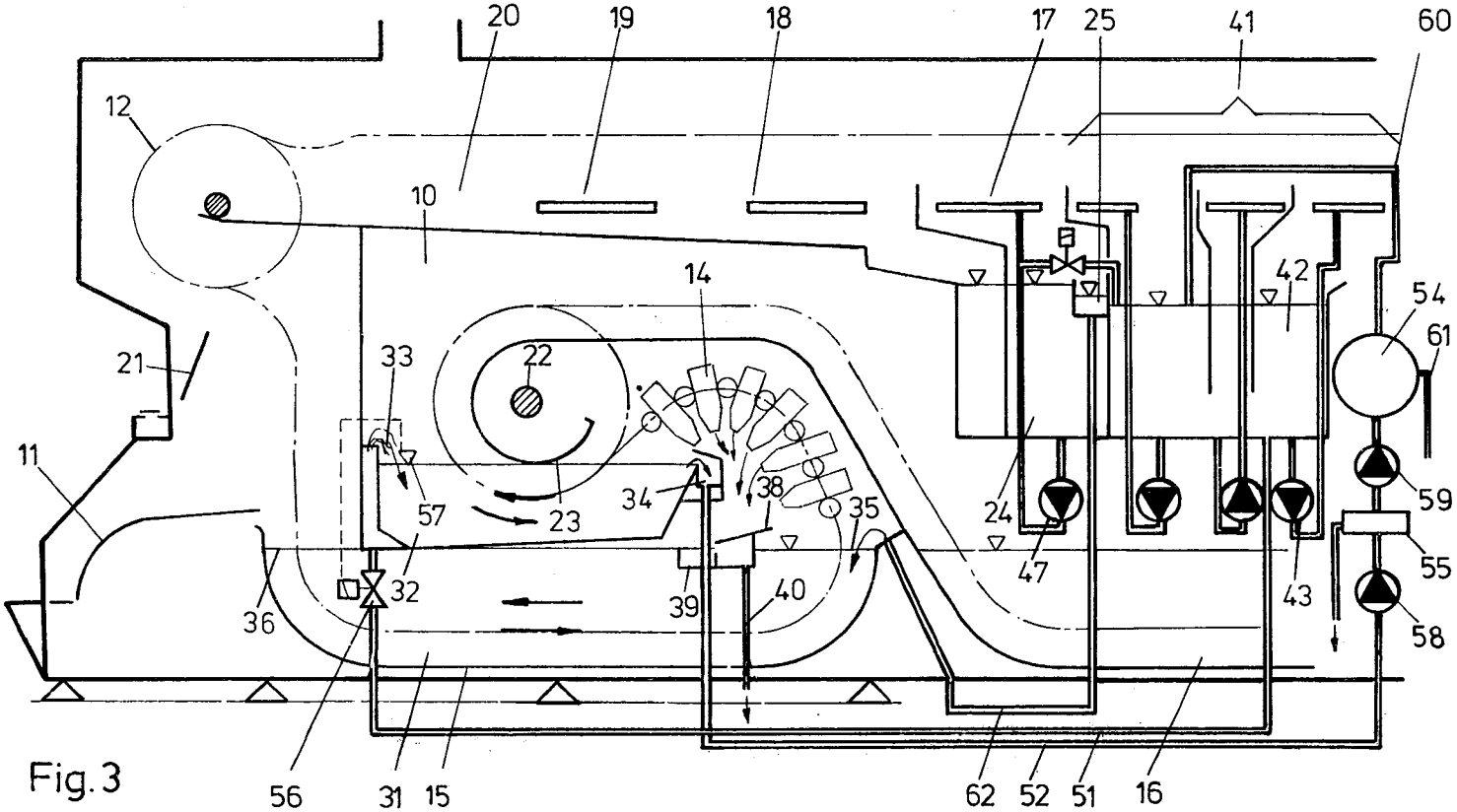
FIG. 3 is still a further modifications of the multi-bath bottle-cleaning machine of FIG. 1.

Referring now to the drawings in detail, according to the embodiments of FIGS. 1–3, the bottles to be cleaned pass through a charging station 11 and an adjacent machine opening into the bottle baskets 14 connected to endless transport chains 13, and forming therewith the transport device 12 within the machine. By means of the transporting device 12, the bottles to be cleaned are first passed through a water pre-softening arrangement 15 and thereupon through a lye softening bath 16. After the bottle baskets 14 are reversed at a non-illustrated rear end of the machine, the bottles pass along the transport path, above the water pre-softening arrangement 15 and the lye bath 16, a plurality of spray zones 17, 18 and 19 respectively having different temperatures, and after passing through a dripping zone 20 are by means of a discharging device 21 removed from the machine. With all embodiments, the water pre-softening arrangement 15 comprises two softening baths, namely softening bath 31 and a softening bath 32 following said bottle conveying device. The bath 32 is arranged above the preceding bath 31, and the water temperature in bath 32 is higher than that in bath 31. Above and within the region of bath 32 there is provided a deviating device 22 equipped with a down-holding device 23 for guiding the transporting device 12 along an S-shaped loop through the bath 31 and 32. The machine chamber 10 receiving the bath 32 and the deviating device 22 is substantially closed and insulated with regard to the bottle charging and discharging stations 11 and 21 respectively and with regard to the spray and drop zones 18, 19 and 20.

According to the embodiment of FIG. 1, the substantially used up spray water is conveyed to the softening bath 32 from the warm water spray station 17 through the overflow 25 of the associated spray vat 24 and through the pipeline 26 at a spot 33 where the transporting device 12 with the bottles to be cleaned exits from the bath 32. The supplied spray liquid may have a temperature of about 54°–60° C. and in counterflow flows to the bottle conveying device through the bath 32. At that side where the bottles enter, the bath 32 has an overflow 34 which feeds to the bath 31 the off-flowing and already noticeably cooled liquid at a spot 35 where the bottles exit from the bath 31. The supplied liquid also flows in bath 31 counter to the bottle conveying device up to the region of the bottle inlets 36 at the bottle inlet 36; the transporting device 12 conveys the bottles into the bath 31 in such a way that they are completely immersed in the bath liquid with the opening directed upwardly and so that the bottles in said region are filled with already cooled-off bath liquid. During the subsequent transport of the bottles from the inlet 36 to the outlet 35 of bath 31, those sections of the transporting device 12 which contact the bath liquid warm up in conformity with the temperature which increases along said bath, whereas the bottles themselves in view of the relatively cool liquid in their interior warm up only slightly. After the bottles have left the bath 31, the bottles pass into an emptying zone 37 in an inclined position whereby the liquid flows out which had entered the bottles during their entry into the bath 31. A collecting plate 38 arranged below the discharging zone 37 passes the out-flowing liquid to an overflow 39 from where the liquid in part flows back into the bath 31 and in part flows through another overflow into a discharge 40 which may also form the main discharge for emptying the liquid from the bath 31. Alternatively, the bath fluid passes from the coolest region of the leading vat to the outside thereof. After the emptying operation into the zone 37, the transporting device 12 conveys the bottles into the following softening bath 32 in such a way that the bottles first immerse into the warmer bath liquid with their opening directed downwardly and then by means of the holding-down device 23 engaging the bottom of the bottles, the bottles completely submerging in the liquid. As a result thereof, the entering of any material quantity of liquids into the empty bottles is prevented, and it will be brought about that the bottles will now warm up to the temperature of the bath 32, and more specifically to the temperature prevailing at the liquid inlet 33. With this temperature which at an optimum is adapted to the temperature conditions of the lye softening bath 16, the bottles and the correspondingly heated up sections of the transporting device 12 exit from the bath 32 and subsequently move into the bath 16 while the hot clouds of bath 16 which expand in the machine chamber 10 advantageously contribute to maintaining the absorbed heat.

According to the embodiment of FIG. 2, the water pre-softening arrangement 15 of the cleaning machine likewise comprises the preceding and succeeding softening baths 31 and 32, the arrangement and conveying of liquid of which substantially corresponds to those of the embodiments of FIG. 1. Also, the transport of the bottles to be cleaned through the baths 31 and 32 by means of the transporting device 12 is substantially effected in the same manner as described in connection with FIG. 1. The individual devices pertaining thereto in particular those of the discharging zone 37 are, however, for the sake of clarity merely indicated or not illustrated at all. In the mentioned example, the cleaning machine additionally has a three-step warm water spraying zone 41 which follows the lye treatment and which is provided with a spray vat 42 arranged therebelow. From said vat 42, the caught spray water enriched with displaced lye is by means of a pump 43 in the pipe network 44 passed in a continuous circuit through an evaporator 45. The formed condensate is for purposes of regenerating the bath liquid returned into the vat 42, and the thickened lye is returned through the tap line 46 into the lye softening bath 16. Also with the warm water spray zone 17 following the spray zone 41, the warm water withdrawn from the spray vat 24 and supplied to zone 17 by means of pump 47 and sprayed there, is circulated within said spray zone. From the overflow 25 of the vat 24, however, a portion of the sprayed off warm water with displaced lye therein is through a conduit 48 conveyed into the softening bath 32. This introduction into the bath 32 is, however, not critical, inasmuch as the quantity of heat conveyed together with the overflow water is immaterial.

For purposes of absorbing heat, the bath 32 is furthermore equipped with a heat exchanger 50 expediently in the form of a double walled container which at the bottle exit area 33 of the bath 32 is through a pipeline 51 connected to the vat 42 of zone 41 and at the oppositely located bottle inlet area of bath 32 communicates through a further pipeline 52, an interposed pump 53 with the last stage of the spray zone 41. Within said circuit, the spray liquid used in the last stage of the spray zone 41 and substantially cooled with regard to the preceding stages is in a continuous manner conveyed to the heat exchanger 50, while the obtained heat serves for heating up the bath 32. The heat flow is effected substantially in countercurrent flow to the feeding device for the bottles to be cleaned. In conformity with the embodiment of FIG. 1, also with this embodiment the bath 32 is provided with an overflow 34 through which the bath liquid passes into the warmest region of the bath 31.

In the embodiment of FIG. 3, the water pre-softening arrangement 15 likewise comprises the preceding softening bath 31 and the succeeding softening bath 32. However, with this embodiment, the liquid of bath 32 is by means of the pipe system 51, 52 incorporated in the spray water circuit of the warm water zone 41, and the heat exchanger 50 is discarded. Another difference consists in that with this spray water circuit a de-salting plant working in conformity with the principle of the reverse osmosis is interposed in the return line 52. The permeator of said de-salting plant is designated with the reference numeral 54 and is preceded by at least one ultrafiltration stage 55. In order to be able to employ such a permeator 54 for the regeneration of the spray water obtained in the spray zone 41, the following features have to be considered:

1. temperature limitation of the feeding medium;
2. limitation of the pH value of the feeding medium.

These conditions are met in the embodiment of FIG. 1 according to which the softening path 32 is included in the regenerating circuit for the spray water of zone 41 which spray water is intermixed with displaced lye from a preceding lye treatment. To this end, in the first stage of the spray zone 41, the liquid which has been withdrawn from the spray vat 42 through pipeline 51 is in a controlled quantity introduced into bath 32 at the bottle exit area 33. The said quantity control is effected by means of a quantity control valve 56 which is interposed in pipeline 51 and which is controlled by means of a level meter 57 at the bath 32. The liquid introduced into the softening bath 32 flows in countercurrent direction to the bottles, moved by the transporting device 12 to the bath 32, to the overflow 34. From here the liquid exiting from bath 32, passes into the return pipeline 52, and by means of a pump 58 is passed through the ultrafilter 55 for removing impurities whereupon said last mentioned liquid, by means of another pump 59 operating in conformity with the principle of the reverse osmosis, is conveyed to the permeator 54. From the permeator 54, the given off permeate passes through a conduit 60 into the vat 42 of the spray zone 41 while the obtained concentrate passes through a conduit 61 into the lye softening bath 16 of the machine.

In view of the cooling-off occuring in the softening bath 32 due to the withdrawal of heat by the container and its transporting device when the bath liquid passes therethrough, the liquid supply to the permeator 54 for regenerating purposes, will reach a temperature which is located in the temperature range suitable for the permeator 54. Also for the required lowering of the pH value, the bath 32 is decisive. In this connection, it should be noted that if from bath 31 per bottle approximately 15 ml water is transferred into the bath 32, with the bath 31 which is supplied from the warm water spray zone 17, 42 through a conduit 62 with warm water, the pH value of the liquid is with the functioning de-salting system to be started substantially neutral. By intermixing with about twice the quantity of spray liquid from the spray zone 41, 42, it is thus possible to keep the pH value of the liquid returned from bath 32 to the permeator 54, in a suitable pH range. Temperature and alkalinity can thus be controlled by means of the through-put velocity of the de-salting circuit which is also obtainable by electrodialysis.

Inasmuch as the softening bath 32 is included in the desalting circuit, this embodiment does not need the supply of liquid from bath 32 into bath 31. The follow-up supply liquid required for the bath 31 is, however, conveyed through conduit 62 from the spray vat 24 of the warm water spray zone 17. If necessary, the quantity of water conveyed from the spray vat 24 to bath 31 may be set by means of a quantity control valve which is adapted to be controlled by the temperature prevailing in the softening bath 31.

As will be evident from the above, the present invention brings about the advantage that the temperature behavior of the preceding softening bath can for instance with a water pre-softening arrangement comprising two softening baths be adjusted at any time precisely in conformity with the temperature conditions of the containers to be cleaned and introduced into the machine, and in conformity with the temperature requirements for the waste water. In particular, as a result thereof, the water temperature in the preceding softening bath can be adapted to the various container temperatures subjected to seasonal variations. Furthermore, the subsequent softening bath for the containers to be cleaned, can be adapted to the temperature of the successive treatment zones, in particular the lye softening bath, so that the containers will pass into the lye softening bath at a temperature adapted to the lye softening bath temperature. At the same time, a considerable improvement of the pre-softening effect for the containers is realized.

The creation of a temperature step arrangement in the pre-softening region as suggested in conformity with the invention yields a considerable improvement of the heat recovery within the cleaning machine. This is due to the fact that the transporting device will withdraw heat from the softening baths fed by the spray water of the warm water spraying operation, which heat would otherwise have to be absorbed in the treatment zones especially in the lye softening bath. On one hand, in this way, less energy is required for the lye softening bath, and on the other hand, the waste water flows off from the preceding softening bath at an admissible temperature in contrast to heretofore known one-step water pre-softening systems in which the heat in the flowing-off water remains unised, i.e., is wasted.

It is, of course, to be understood that the present invention is, by no means, limited to the specific showing in the drawings, but also comprises any modifications within the scope of the appended claims.

What we claim is:

1. A cleaning machine in which a transport device transports containers with open ends from an input station serially through baths in a plurality of vats and through a spray station to a discharge station where they are removed from the machine, said machine comprising in combination a leading vat adjacent said input station which receives containers submerged in upright position on said transport device, and a trailing vat following said leading vat which receives containers from said leading vat, said transport device including an emptying zone between said vats in which said transport device inverts said containers with open ends downward to empty the liquid received thereby in the leading vat, said containers being transported by said transport device with their open ends downward through said trailing vat so that said containers receive no liquid therein from said trailing vat, said containers being transported by said transport device further through baths having liquid at a higher temperature than in said leading and trailing vats to a spray station where said containers are sprayed with heated liquid, a spray vat that receives said heated liquid from said spray station, and a liquid passage that extends from said spray vat to said trailing vat and that conveys the heated liquid to said trailing vat used to heat said containers prior to transport thereof through heated liquid in succeeding baths, a liquid passage that extends from said trailing vat to said leading vat so that the liquid passes to said leading vat at a lower temperature than from said spray vat used in an energy saving manner to warm the containers entering the machine, and a discharge outlet for liquid from said leading vat, said discharged liquid being at a low temperature better for environmental purposes due to absorption of heat by the containers which enters said machine.

2. A cleaning machine for containers with open ends, in which a transport device transports said containers from an input station through a presoftening stage, through successive washing vat stages in which said containers are transported through vats of heated liquid and through a spray station in which said containers are sprayed with heated liquid, said presoftening stage comprising a leading vat including a container exit end and including liquid receiving containers submerged in said liquid with their open ends upward, followed by a trailing vat including a container exit end through which said transport device transports said containers from said leading vat, said transport device including an emptying zone between said vats in which said transport device turns said containers from said leading vat upside down to empty the liquid from said containers, said containers being transported by said transport device with their open ends downward through said trailing vat so that said containers are not filled with liquid in said trailing vat, said containers then being transported by said transport device through the washing vats and said spray station, a spray vat which receives liquid from said spray station, a liquid passage which extends from said spray vat to the container exit end of said trailing vat and which delivers the spray water to said trailing vat, a liquid outlet at the opposite end of said trailing vat where said containers enter said trailing vat, said liquid outlet having a connection to said leading vat at a point adjacent the container exit end of said leading vat, and a discharge outlet from said leading vat, so that the containers passing through said leading vat receive heat from the heated liquid from said spray station used in an energy saving manner to heat said containers for succeeding stages and the containers in said leading vat are filled with liqiid received from said trailing vat at a lower temperature than said liquid in said spray station to heat containers from the input station sufficiently for delivery to said trailing vat free of need for costly external heat supply thereto.

3. A machine in combination according to claim 1, in which of said at least two vats the trailing vat is arranged above the leading vat, and which includes overflow conduit means forming said liquid passage leading from said trailing vat to said leading vat.

4. A machine in combination according to claim 1, in which said leading vat has an inlet and an outlet, and which includes plate means arranged within the region of said outlet for catching liquid discharged from said containers when inverted while being passed by said transport device from said leading vat to said trailing vat and for passing said caught liquid to said leading vat.

5. A machine in combination according to claim 1, in which said transporting means includes direction-reversing means arranged above said trailing vat for continuing the advancing movement of said transport device in a direction opposite to the direction of movement of said transporting means up to said direction-reversing means, said direction-reversing means being located above said trailing vat.

6. A machine in combination according to claim 5, which includes holding-down means associated with said direction-reversing means for keeping containers to be cleaned when passing through a softening bath in said trailing vat submerged therein.

7. A machine in combination according to claim 1, which includes heat exchanger means having an inlet and outlet and being associated with said trailing vat, and a precleaning spray zone for precleaning spraying of containers with liquid at a higher temperature than that in said trailing vat, said precleaning spray zone being connected to said trailing vat.

8. A machine in combination according to claim 7, which includes a warm water spray zone having an inlet and an outlet and also includes a water-regenerating and de-salting plant.

9. A machine in combination according to claim 8, in which said water regenerating and de-salting plant is a reverse osmosis de-salting plant with a preceding ultrafiltration means.

10. A machine in combination according to claim 8, which includes controllable quantity control valve means interposed in said liquid passage from said spray vat.

11. A machine in combination according to claim 10, which includes level gauge means associated with said trailing vat for controlling said quantity control valve.

12. A machine in combination according to claim 7, which includes conduit means associated with at least one of said vats and connected to a warm water supply.

13. A machine in combination according to claim 12, which includes control means associated with said conduit means for controlling the supply of warm water through said conduit means in conformity with the temperature of a softening bath in at least one of said vats.

14. The method of washing containers which are open at one end in a bottle cleaning machine, and in which said containers are transported successively from a charging station where they enter the machine through heated liquid baths and are sprayed with heated liquid, the steps in combination therewith comprising: first transporting said containers successively from said charging station through a first liquid bath in a leading vat with the containers submerged in upright position to fill with liquid in said first liquid bath, inverting said containers leaving said bath to empty said containers of liquid, then transporting said containers through a second bath in a trailing vat with the containers in inverted position so liquid does not enter to fill the containers, transporting said containers through the machine to a spray station to spray said containers with heated liquid, conducting the heated liquid from said spray station back to said second bath in said trailing vat to heat said containers in said second bath in said trailing vat, conducting liquid from said second bath in said trailing vat to said first liquid bath in said leading vat to warm said containers just entering said machine to a lower temperature than in said second bath in said trailing vat, and discharging said liquid at a low temperature better for environmental purposes after warming said containers in an energy saving manner when entering at said charging station free of need for costly external heat supply thereto from the outside of the machine.

15. A method according to claim 14, which includes in combinations the step of passing the bath fluid in said leading and trailing vats in countercurrent flow to the direction of movement of said transporting means.

16. A method according to claim 14, which includes in combination the step of passing the bath fluid to remove heat from the coolest region of the leading vat to the outside thereof.

17. A method according to claim 14, for use in connection with the cleaning of containers in a plant also comprising a vat filled with lye and further comprising a spray water zone directly preceding said lye filled vat, and furthermore comprising a water regenerating and de-salting plant, which includes in combination the steps of feeding spray water from said spray water zone to the warmest bath region of said trailing bath fluid, and withdrawing liquid from the coolest bath region of said trailing vat for the water regeneration and de-salting plant.

* * * * *